US008869520B2

(12) United States Patent
Vigholm et al.

(10) Patent No.: US 8,869,520 B2
(45) Date of Patent: Oct. 28, 2014

(54) LOAD SENSING SYSTEM, WORKING MACHINE COMPRISING THE SYSTEM, AND METHOD FOR CONTROLLING A HYDRAULIC FUNCTION

(75) Inventors: Bo Vigholm, Stora Sundby (SE); Andreas Ekvall, Hallstahammar (SE)

(73) Assignee: Volvo Construction Equipment AB, Eskilstuna (SE)

( * ) Notice: Subject to any disclaimer, the term of this patent is extended or adjusted under 35 U.S.C. 154(b) by 1024 days.

(21) Appl. No.: 12/741,423

(22) PCT Filed: Nov. 21, 2007

(86) PCT No.: PCT/SE2007/001028

§ 371 (c)(1),
(2), (4) Date: May 5, 2010

(87) PCT Pub. No.: WO2009/067050

PCT Pub. Date: May 28, 2009

(65) Prior Publication Data

US 2010/0242464 A1 Sep. 30, 2010

(51) Int. Cl.
*E02F 9/22* (2006.01)
*F15B 11/16* (2006.01)

(52) U.S. Cl.
CPC ..... *E02F 9/2228* (2013.01); *F15B 2211/6309* (2013.01); *F15B 2211/6336* (2013.01); *F15B 2211/6346* (2013.01); *F15B 2211/6316* (2013.01); *E02F 9/2235* (2013.01); *F15B 2211/61* (2013.01); *F15B 11/165* (2013.01); *E02F 9/2296* (2013.01); *F15B 2211/3144* (2013.01); *F15B 2211/20523* (2013.01); *F15B 11/162* (2013.01); *F15B 2211/20546* (2013.01); *F15B 2211/6313* (2013.01); *F15B 2211/253* (2013.01); *F15B 2211/30565* (2013.01)
USPC ..... 60/422; 60/459; 60/445

(58) Field of Classification Search
CPC ..... F15B 2211/20546; F15B 2211/3144; F15B 2211/61; F15B 11/165; F15B 11/2211; F15B 11/6336; F15B 11/162; F15B 2211/20523; F15B 2211/253; F15B 2211/6316; F15B 2211/30565; F15B 2211/6346; F15B 2211/6313; F15B 2211/6309; E02F 9/2228; E02F 9/2296; E02F 9/2235
USPC ..... 417/44.2; 60/420, 422, 426, 484, 459, 60/445
See application file for complete search history.

(56) References Cited

U.S. PATENT DOCUMENTS 5,295,795 A * 3/1994 Yasuda et al. ..... 417/213
5,701,793 A * 12/1997 Gardner et al. ..... 91/361

(Continued)

FOREIGN PATENT DOCUMENTS

| | | | |
|---|---|---|---|
| EP | 0597109 | A1 | 5/1994 |
| WO | 2006011835 | A1 | 2/2006 |
| WO | 2006088399 | A1 | 8/2006 |
| WO | 2006107242 | A1 | 10/2006 |

OTHER PUBLICATIONS

International Search Report for corresponding International Application PCT/SE2007/001028.
International Preliminary Report on Patentability for corresponding International Application PCT/SE2007/001028.

*Primary Examiner* — Ned Landrum
*Assistant Examiner* — Logan Kraft
(74) *Attorney, Agent, or Firm* — WRB-IP LLP

(57) ABSTRACT

A load sensing system includes a first assembly of actuators for controlling a first hydraulic function, a pump adapted to supply the actuators with pressurized hydraulic fluid, an electrically controlled valve adapted to control the output pressure of the pump via a hydraulic signal, a first pressure sensor for detecting a load pressure of the first actuator assembly, and a control unit adapted to receive a signal with information about the load pressure detected by the first pressure sensor and to generate a control signal, corresponding to the detected load pressure, to the electrically controlled valve.

15 Claims, 3 Drawing Sheets

(56) References Cited

U.S. PATENT DOCUMENTS 6,988,363 B2 1/2006 Bitter
7,712,309 B2 * 5/2010 Vigholm ..... 60/414
2005/0241304 A1 * 11/2005 Bankestad et al. ..... 60/445
2006/0086088 A1 * 4/2006 Pfaff ..... 60/420
2007/0006580 A1 * 1/2007 Hesse ..... 60/452

* cited by examiner

LOAD SENSING SYSTEM, WORKING MACHINE COMPRISING THE SYSTEM, AND METHOD FOR CONTROLLING A HYDRAULIC FUNCTION

BACKGROUND AND SUMMARY

The present invention relates to a load sensing system, comprising a first assembly of actuators for controlling a first hydraulic function, a pump adapted to supply said actuators with pressurized hydraulic fluid, and an electrically controlled valve adapted to control the output pressure of the pump via a hydraulic signal. In particular, the invention relates to a working machine comprising the system. A working machine in the form of a wheel loader has several different work functions which are hydraulically controlled, such as lifting and tilting of an implement and steering of the machine. As a rule, the actuators are constituted of linear motors in the form of hydraulic cylinders. The invention further relates to a method for controlling a hydraulic function.

Below, the invention will be described in connection with the operation of a wheel loader. This is a preferred, but by no means limiting application of the invention. The invention can for example also be used for other types of working machines (or work vehicles), such as a backhoe loader, an excavator, or an agricultural machine such as a tractor.

Thus, the hydraulic system is load sensing. This means that the pump senses the pressure (a LS signal) from the activated hydraulic cylinders. The pump then sets a pressure which is a specific number of bar higher than the pressure of the cylinders. This brings about an oil flow out to the control cylinders, the level of which depends on the extent to which the activated control valve is operated. As a rule, the so called control pressure is fixed. The control pressure is the difference between the pump pressure and the pressure of the load. As a rule, the pump is adapted to set a fixed pressure which is 20-30 bar higher than the detected load pressure. Thereby, a level of the control pressure which is suitably balanced for different working positions is selected. There are also systems where the control pressure can be varied.

It is desirable to achieve a load sensing system which creates prerequisites for a more efficient operation with respect to energy consumption and which is reliable in operation. The invention particularly, according to an aspect thereof, seeks to achieve a more optimal system, where the control pressure can be adapted to different working positions or operating conditions.

According to an aspect of the present invention, a load sensing system comprises

- a first assembly of actuators for controlling a first hydraulic function;
- a pump adapted to supply said actuators with pressurized hydraulic fluid;
- an electrically controlled valve adapted to control the output pressure of the pump via a hydraulic signal, characterized in that the system comprises
- a first pressure sensor for detecting a load pressure of the first actuator assembly, and
- a control unit adapted to receive a signal with information about the load pressure detected by the first pressure sensor and to generate a control signal, corresponding to the detected load pressure, to the electrically controlled valve.

The first hydraulic function is preferably constituted of a lift function, but could be constituted of another function, such as the tilt or steering function.

By means of achieving a variable control pressure in this way, the pump can for example be at a low basic level and set on a pressure which is only 5-10 bar higher, that is to say as small a pressure increase as possible (the limit is defined by requirements on lubricating and cooling ability). If a higher control pressure is required, for example 30 bar, the electrically controlled pump control valve (LS valve) has to compensate for this. According to an example, the actuator (cylinder) has the pressure level 100 bar. The LS valve then sets the pressure level 125 bar and the pump itself adds an additional 5 bar, which means that the pump pressure becomes 130 bar in total. Thereby, lower drag losses (idling losses) can be obtained, thanks to low standby pressure. When no flow is required from the pump, its idles at for example 5 bar instead of 30 bar.

Furthermore, prerequisites for smaller control losses are created with lower output flows to the functions. The smaller the flow demanded by a function is, the lower a control pressure can be used, since the slide in a control valve for the function is opened more. If the operator demands 50% more flow to a function, the slide can be fully opened and the control pressure can be decreased, for example, from 30 bar down to 8 bar via the electrically controlled LS valve. In practice, this means that the larger the lever deflection being used is, the higher a control pressure will be used.

Furthermore, prerequisites for a powerful shake-out function are created. In certain situations, it is desired to be able to shake a function, for example shaking the bucket in order to shake out the contents properly. In these situations, shaking can be activated by means of a button or by moving the lever back and forth in a certain pattern. If the computer registers that the operator desires to perform shaking, the pump can be set to a higher pressure level via the electrical LS valve and thereby generate larger flow via a higher control pressure.

According to a preferred example, the electrically controlled pump control valve is adapted to assume such a position that the hydraulic signal to the pump generates a substantially constant pump pressure when the input signal to the valve from the control unit drops out. The constant pump pressure preferably constitutes a maximum pressure. This means that the hydraulic system then acts as a constant pressure system. Accordingly, the pump provides flow as required, but operates at maximum pressure all the time. Thus, the operator can continue with his/her work also in case of an electronics malfunction.

According to another preferred embodiment, the system comprises a steering function. As a rule, a valve unit in the form of an orbitrol unit is used for the steering function. According to prior art, there are problems to get the orbitrol steering stable, since resonances with respect to pressure fluctuations arise. This is amplified since the hydraulic LS signal from the orbitrol unit is also oscillating. By instead reading the LS signal of the orbitrol unit via pressure sensors and setting a higher LS pressure via the electrical LS valve, a stable LS signal to the pump can be obtained, which means a filtered signal.

According to another preferred example, the system comprises a position sensor for the actuator. In this way prerequisites for end position damping are created. If the system has a separate feed pump for a function, for example for the steering function, the electrical LS signal can be used for end position damping. This means that the control unit registers that the actuator (cylinder) is approaching the end position via positions sensors. The electrical LS valve can then lower the control pressure to a suitable level, so that the maximum steering rate is reduced, which means that the operator cannot exceed a certain steering rate.

Positions sensors also create prerequisites for a power control. In certain situations, it is desired to reduce the maximum possible hydraulic power output, for example because the engine does not have the power at low rpms. The electrically controlled functions can easily be limited, but the problem is the steering orbitrol (which is not electrically controlled). By means of electrical LS control, the maximum flow can be reduced by decreasing the control pressure. The hydraulic power can be calculated if the pressure level of the pump (pumps) and its/their flow and the efficiency of the system are known. For the orbitrol unit, the flow can be calculated by means of the computer reading the position of the steering cylinders in time via position sensors. If the flow is too high in this working position (depending on, amongst other things, the pressure level and other factors), a reduction, of the control pressure, to a suitable, acceptable maximum flow can be made. If a common pump is used for steering and working hydraulic, this is not a problem either. The working hydraulic can be reduced via its electrically controlled valves, and since the steering has higher priority than other functions, the computer can check how much power the operator demands via the steering (flow via the position sensor of the steering cylinder and pressure via pressure sensors). If this power level falls below the allowed power level, the remaining power can be used for the working hydraulic and limitation only takes place there. In this power level exceeds the allowed power level, the working hydraulic gets no power at all, which means that the pressure level of the pump is only dependent on the LS pressure of the steering and thereby reduction of maximum flow can be accomplished with a suitable LS pressure via the electrical LS valve. A certain degree of steering should always be available, wherein the lowest LS level is obtained directly from the orbitrol unit if the electrical LS signal is set at zero, that is to say the control pressure then becomes equal to the control pressure of the pump, which is at the level 5-10 bar. This also provides better security, since the LS signal for the steering never can be completely set at zero via the electrical LS valve.

According to another preferred example, the system comprises a plurality of assemblies of actuators, which are adapted to control different functions, and at least one pressure sensor associated with each of the actuator assemblies for detecting a load pressure of the respective assembly.

In this way, prerequisites for a reduction of pressure fluctuations in the system are created. The control unit registers pressure at different positions in the system. If the control unit registers an abnormal pressure oscillation, a change of the control pressure can be induced, with the purpose of moving away from the point of resonance of the system. If several functions are used simultaneously, the slides in the control valves can be opened or closed more, depending on whether the control pressure is increased or decreased, with the purpose of obtaining the same flow level. If the control pressure is at a low level when the resonance occurs, an increase of the control pressure can be made. If the control pressure already is high, a decrease with a certain allowed increment can be made. The temporary change will remain until a certain change with respect to pressure and flow occurs in the system.

It is desirable to achieve a method which, with respect to energy consumption, provides an efficient control of a load sensing system. In particular, the invention, according to an aspect thereof, aims at a method where the control pressure can be adapted to different working positions, or operating conditions.

According to an aspect of the present invention, a method comprises detecting a load pressure of an actuator, adapted to control a hydraulic function via a pressure sensor, and controlling a pump, adapted to supply said actuator with pressurized hydraulic fluid corresponding to the detected load pressure, via a hydraulic signal.

According to a preferred example, the method comprises the step of actuating an electrically controlled valve via an electrical signal corresponding to the detected load pressure, said valve controlling the output pressure of the pump correspondingly via said hydraulic signal. This creates prerequisites for a system reliable in operation, since the electrically controlled valve can be arranged so that the pump receives a hydraulic signal even if the input signal to the electrically controlled valve should drop out.

According to another preferred embodiment, the method comprises the steps of determining a desired pump pressure in proportion to (and usually at a level above) the detected load pressure, and controlling the pump correspondingly. Accordingly, the control pressure can be varied based upon different operating conditions. This is preferably done by means of detecting also an output pressure from the pump, and generating the control signal based also upon the detected output pump pressure.

According to another preferred example, the method comprises the steps of detecting the position of an operator-controlled element associated with said hydraulic function, and actuating a control valve arranged between the pump and the actuator based upon the detected position of the operator-controlled element. The method preferably comprises the step of coordinating the control of the pump and the actuation of the control valve. This creates prerequisites for lower control losses at smaller output flows to the functions. The lower the flow requested for a function is, the lower a control pressure can be used, since the slide in the control valve is opened more.

Further preferred embodiments of the invention and advantages associated therewith are apparent from the following description.

BRIEF DESCRIPTION OF FIGURES

The invention will be described more closely in the following, with reference to the embodiments shown in the attached drawings, wherein.

DETAILED DESCRIPTION OF PREFERRED EMBODIMENTS

Figure 1:
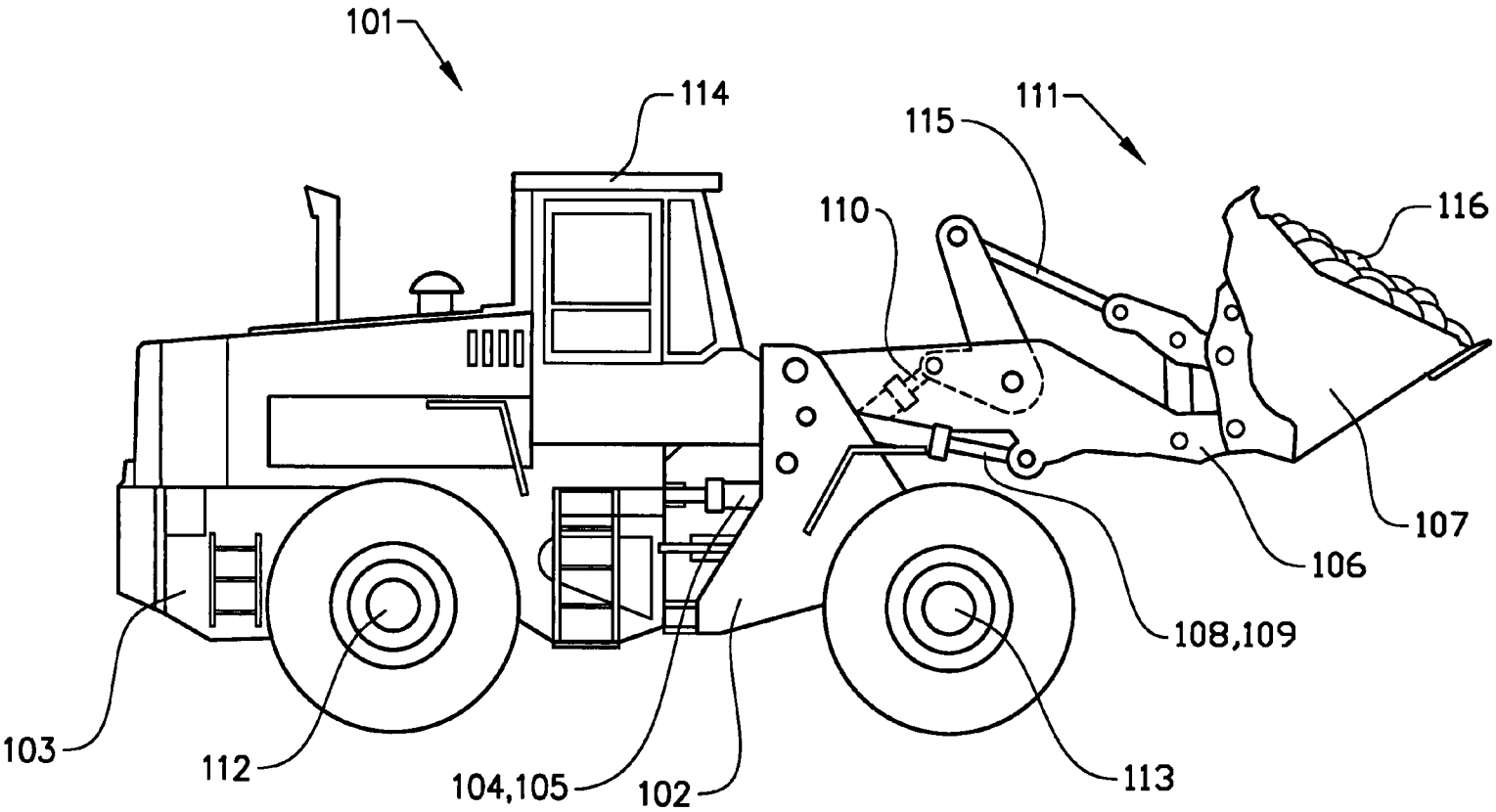
FIG. 1 shows a side view of a wheel loader.

FIG. 1 shows a side view of a wheel loader 101. The wheel loader 101 comprises a front vehicle section 102 and a rear vehicle section 103, said sections each comprising a frame and a pair of drive shafts 112, 113. The rear vehicle section 103 comprises a operator's cab 114. The vehicle sections 102, 103 are connected to each other in such a way that they can be pivoted relative to each other about a vertical axis by means of two hydraulic cylinders 104, 105 which are connected to the two sections. Accordingly, the hydraulic cylinders 104, 105 are disposed on different sides of a centre line in the longitudinal direction of the vehicle for steering, or turning the wheel loader 101.

The wheel loader 101 comprises an equipment 111 for handling objects or material. The equipment 111 comprises a load-arm unit 106 and an implement 107 in the form of a bucket which is fitted on the load-arm unit. Here, the bucket 107 is filled with material 116. A first end of the load-arm unit 106 is pivotally connected to the front vehicle section 102 in order to achieve a lifting movement of the bucket. The bucket 107 is pivotally connected to a second end of the load-arm unit 106 in order to achieve a tilting movement of the bucket.

The load-arm unit 106 can be raised and lowered relative to the front section 102 of the vehicle by means of two hydraulic cylinders 108, 109, each of which is connected at one end to the front vehicle section 102 and at the other end to the load-arm unit 106. The bucket 107 can be tilted relative to the load-arm unit 106 by means of a third hydraulic cylinder 110, which is connected at one end to the front vehicle section 102 and at the other end to the bucket 107 via a link arm system.

Below, a number of embodiments of a control system for the hydraulic functions of the wheel loader 101 will be described more closely.

Figure 2:
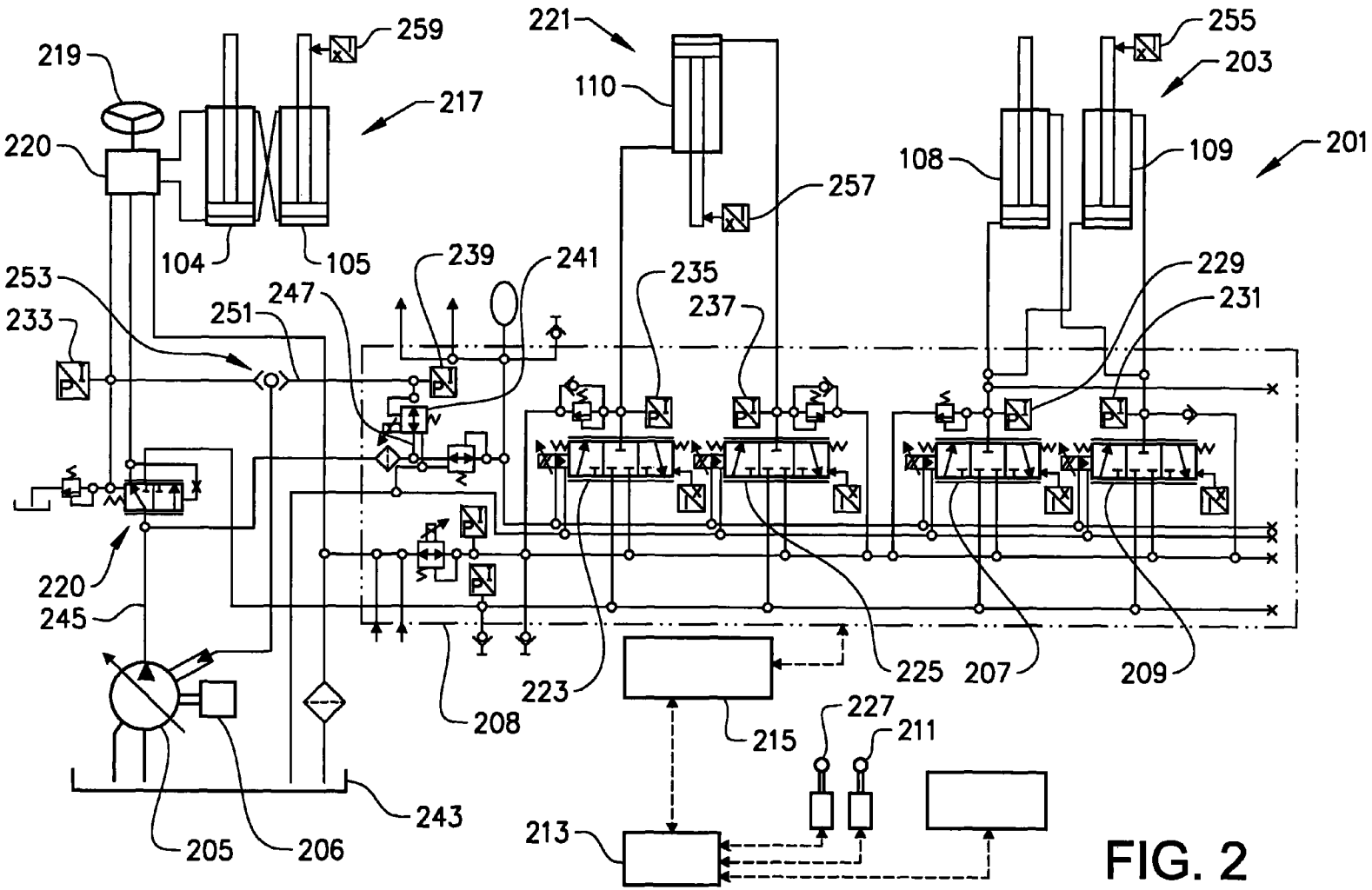
FIGS. 2-3 show two different embodiments of a system for the wheel loader.

A first embodiment of the system is shown in FIG. 2. The system 201 comprises a first assembly 203 of actuators for controlling a first hydraulic function, namely lifting and lowering of the load-arm unit. Here, the actuators are constituted of the lift cylinders 108, 109.

The system 201 further comprises a pump 205 adapted to supply said actuators with pressurized hydraulic fluid via a hydraulic circuit. The pump 205 is driven by the vehicle's propulsion engine 206, in the form of a diesel engine. The pump 205 has a variable displacement. The pump 205 is preferably adapted for infinitely variable control. The system 201 comprises a valve device 208 (se the dash-dotted line) which comprises a hydraulic circuit having a plurality of control valves.

Two control valves, in the form of flow valves, 207, 209, are arranged between the pump 205 and the lift cylinders 108, 109 in the circuit in order to control the lifting and lowering movement. While a first one of these valves 207 is arranged to connect the pump 205 to the piston side, a second one of these valves 209 is arranged to connect the tank 243 to the piston rod side. Furthermore, the first valve 207 is arranged to connect the tank 243 to the piston side and the second valve 209 is then arranged to connect the pump 205 to the piston rod side. This offers large possibilities for varying the control. In particular, it is not necessary to connect the pump and tank simultaneously to the function.

The system 201 further comprises a control unit 213, or computer, which contains software for controlling the functions. The control unit is also called a CPU (central processing unit) or ECM (electronic control module). The control unit 213 suitably comprises a microprocessor.

An operator-controlled element 211, in the form of a lift lever, is operatively connected to the control unit 213. The control unit 213 is adapted to receive control signals from the control lever and to actuate the control valves 207, 209 correspondingly (via a valve control unit 215). The control unit 213 preferably controls more general control strategies and the control unit 215 controls basic functions of the valve unit 208. Naturally, the control units 213, 215 can also be integrated into a single unit. When controlling the pump 205, there is an oil flow out to the cylinders 108, 109, the level of which depends on the extent to which the activated valves 207, 209 are operated.

The system 201 further comprises a second assembly 217 of actuators for controlling a second hydraulic function, namely the steering of the working machine. Here, the actuators are constituted of the steering cylinders 104, 105. An operator-controlled element 219, in the form of a steering-wheel, is hydraulically connected to the steering cylinders 104, 105, via a valve unit in the form of an orbitrol unit 220, for direct-control thereof.

The system 201 further comprises a third assembly 221 of actuators for controlling a third hydraulic function, namely tilting of the implement. Here, said actuator is constituted of the tilt cylinder 110. As for the lift function, two control valves 223, 225 are arranged between the pump 205 and the tilt cylinder 110 for controlling the forward and return movement of the implement relative to the load-arm unit. An operator-controlled element 227, in the form of tilt lever, is operatively connected to the control unit 213. The control unit 213 is adapted to receive control signals from the tilt lever and to actuate the control valves 223, 225 correspondingly.

A prioritizing valve 220 is arranged on the outlet conduit 245 of the pump for automatically prioritizing that the steering function receives the required pressure before the lift function (and the tilt function).

As mentioned, the system 201 is load sensing and comprises, for this purpose, a plurality of pressure sensors 229, 231, 233, 235, 237 for detecting load pressures of each of said functions. The lift function of the system comprises two pressure sensors 229, 231, out of which one is arranged on a conduit to the piston side of the lift cylinders and the other on a conduit to the piston rod side of the lift cylinders. In a corresponding way, the tilt function of the system comprises two pressure sensors 235, 237, out of which one is arranged on a conduit to the piston rod side of the tilt cylinder and the other on a conduit to the piston side of the tilt cylinder. The steering function comprises a pressure sensor 233 on a conduit connected to the steering cylinders 104, 105. More precisely, the pressure sensor 233 is situated on the LS conduit which receives the same pressure as on one cylinder side when steering in one direction and as on the other cylinder side when steering in the other direction. In neutral, the LS conduit is connected to tank.

The system further comprises an electrically controlled valve 241 adapted to control the output pressure of the pump via a hydraulic signal. The system 201 comprises an additional pressure sensor 239 for detecting a pressure which is indicative of an output pressure from the pump. More precisely, the pressure sensor 239 is adapted to detect the pressure in a position downstream the electrically controlled valve 241. Accordingly, the pressure sensor 239 senses the pump pressure directly when the valve 241 is fully open. In normal operating conditions, the pressure sensor 239 detects the modulated pressure from the valve 241. Accordingly, the control unit 213 is adapted to receive a signal from the pump pressure sensor 239 with information about the pressure level.

Thus, the control unit 213 is operatively connected to the pressure sensors 229, 231, 233, 235, 237, 239 and the electrically controlled valve 241. Accordingly, the control unit 213 receives electrical signals from the pressure sensors 229, 231, 233, 235, 237, 239 and generates an electrical signal for actuating the electrical valve 241. Furthermore, the control unit 213 is adapted to generate a control signal, corresponding to the detected load pressure, to the electrically controlled valve 241.

As previously stated, the control unit 213 is adapted to receive signals from the control levers 211, 227. When the operator desires to lift the bucket, the lift lever 211 is operated. The control unit receives a corresponding signal from the lift lever 211 and actuates the control valves 207, 209 to such a position that the pump is connected to the piston side of the lift cylinders 108, 109 and the piston rod side of the lift cylinders is connected to a tank 243. Furthermore, the control unit receives signals from the load pressure sensor 229 on the piston side of the lift cylinders and from the pressure sensor 239 downstream the pump. Based upon the received signals, a desired pump pressure at a level above the detected load pressure is determined, and the electrically controlled pump control valve 241 is actuated correspondingly.

The control unit 213 is preferably adapted to coordinate the opening degree of the control valves 207, 209 and the output pressure of the pump 205 for optimum operation. According to an example, the lower the flow which is requested for a function is, the lower a control pressure can be used since the slide in the control valve is opened more. If the operator demands 50% flow to a function, the slide can be opened completely and the control pressure can be decreased, for example, from 30 bar down to 8 bar via the electrically controlled LS valve. In practice, this means that the larger the lever deflection being used is, the higher a control pressure will be used. Thus, according to a preferred embodiment, the control unit 213 receives a signal from the lift lever with information about desired lifting or lowering movement. Furthermore, the control unit 213 detects the pressure in the lift cylinders 108, 109 via the pressure sensor 229. Thereafter, a desired output pressure is determined and the electrically controlled valve 241 is actuated correspondingly. Furthermore, the control unit 213 detects the pressure in the pressure sensor 239 downstream the electrically controlled valve 241 and adjusts the output pressure to the desired level via corresponding actuation of the electrically controlled valve 241.

The tilt function is controlled in a corresponding manner as the lift function. When steering the machine, the pressure sensor 233 of the steering function detects a steering load pressure and generates a corresponding load signal. The control unit 213 receives this load signal and a signal from the pressure sensor 239 on the outlet conduit of the electrically controlled valve 241. Based upon the received signals, a desired pump pressure at a level above the detected load pressure is determined, and the electrically controlled pump control valve 241 is actuated correspondingly.

When several functions are used simultaneously, the detected load pressures are compared and the pump 205 is controlled corresponding to the highest one of the detected load pressures.

According to a preferred example, the control unit 213 is adapted to determine the desired pump pressure so that a differential pressure between the detected load pressure and the pump pressure is varied based upon different operating conditions. According to one example, the control pressure is adjusted up to a high level when it is desired to shake a function with a large force, as when performing bucket shake-out.

The control unit 213 is adapted to continuously determine desired pump pressure and generate corresponding signals during operation.

The electrically controlled pump control valve 241 is arranged in connection with an outlet conduit 245 from the pump 205. More precisely, the pump control valve 241 is arranged for controlling opening degree on a conduit 247 connected between the outlet conduit 245 from the pump 205 and a conduit 251, which in its turn is connected to the pump 205 for controlling it with a hydraulic signal. The pump control valve 241 is adapted to assume such a position that the hydraulic signal to the pump 205 generates a substantially constant pump pressure (maximum pump pressure) when the input signal to the valve 241 from the control unit 213 drops out. More precisely, the electrically controlled pump control valve 241 is spring-loaded and adapted to assume said position providing a constant pump pressure via spring force. Accordingly, the pump control valve 241 is adapted to assume an open position so that the control signal to the pump is constituted of the pump's own output pressure when the input signal to the pump control valve 241 from the control unit 213 drops out. One could say that there is a short circuit in the hydraulic circuit. Thus, the pump control valve 241 could be said to be inverse. Accordingly, the hydraulic LS signal rises to the maximum pressure level if there is an electronics malfunction. This means that the hydraulic system then acts as a constant pressure system. Accordingly, the pump provides flow as required, but operates at the maximum pressure all the time. Thus, the operator can continue his/her work also in case of an electronics malfunction.

Accordingly, the electrically controlled pump control valve 241 is adapted to be infinitely adjustable between two end positions, a first end position which corresponds to the pump generating a minimum pressure and a second end position which corresponds to the pump generating a maximum pressure.

Accordingly, the pump pressure sensor 239 is arranged downstream the pump control valve 241, that is to say on the LS conduit to the pump 205. This creates prerequisites for a stable control system.

A hydraulic means 253, in the form of a reversing valve, is arranged on the conduit 251 between the electrically controlled pump control valve 241 and the pump. The reversing valve 253 is adapted to receive the hydraulic signals from the second actuator assembly 207 (for the steering function) and the pump control valve 241. Furthermore, the reversing valve is adapted to control the pump 205 corresponding to the received signal having the largest load pressure. Accordingly, the hydraulic means (reversing valve) 253 selects the higher pressure in an output signal made up of two input pressure signals.

The first assembly 203 of actuators (for the lift function) comprises a sensor 255 for detecting cylinder position. This can, for example, be used for controlling end position damping, that is to say deceleration of the cylinder movement when approaching the end position. A position sensor 257, 259 is also arranged for detecting cylinder position for the tilt function and the steering function.

Figure 3:
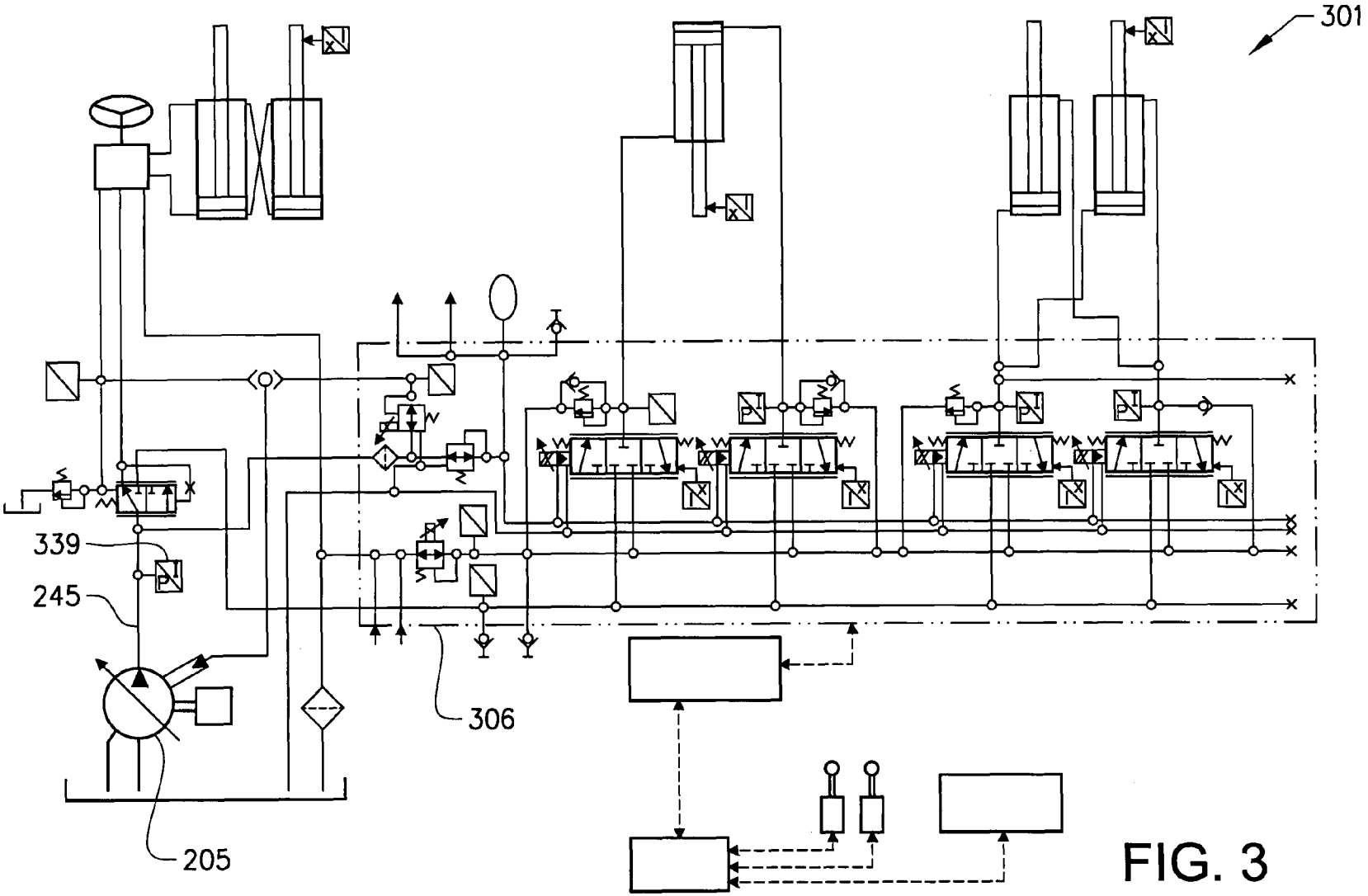

FIG. 3 shows a second embodiment of the control system 301. Unlike the first embodiment, a pressure sensor 339 for detecting output pump pressure is arranged on the outside of a valve device 306 which comprises a hydraulic circuit having control valves, etc. More precisely, the pressure sensor 339 is arranged on the outlet conduit 245 of the pump 205 and directly downstream the pump 205. Accordingly, the control unit reads and adjusts the output pressure of the pump via the pressure sensor 339 directly downstream the pump instead of the LS signal pressure. This creates prerequisites for an accurate value of the output pump pressure.

The invention should not be regarded as limited to the above-described exemplary embodiments, but a number of further variants and modifications are conceivable within the scope of the following claims.

In the foregoing description, the term "electrically controlled valve" has been used for a directly electrically actuated valve on a hydraulic conduit, that is to say the valve is adapted to be actuated by an electrical input signal. There are, of course, variants of this which fall within the scope of the term "electrically controlled valve", such as an assembly of several valves, out of which a first valve is arranged on the hydraulic conduit and a second, directly electrically actuated, valve is adapted to actuate the first valve via a hydraulic signal.

According to an alternative, the embodiments according to FIGS. 2 and 3 can be combined, wherein such a system includes both the pressure sensor 239 downstream the electrically controlled valve 239 and the pressure sensor 339 directly downstream the pump.

The invention claimed is:

1. Load sensing system comprising a first assembly of actuators for controlling a first hydraulic function, a pump adapted to supply the actuators with pressurized hydraulic fluid, an electrically controlled valve adapted to control the output pressure of the pump via a hydraulic signal, a first pressure sensor for detecting a load pressure of the first actuator assembly, and a control unit adapted to receive a signal with information about the load pressure detected by the first pressure sensor and to generate a control signal, corresponding to the detected load pressure, to the electrically controlled valve, wherein the control unit is adapted to determine the desired pump pressure so that a differential pressure between the detected load pressure and the pump pressure is varied based upon different operating conditions, wherein the electrically controlled pump control valve is adapted to assume such a position that the hydraulic signal to the pump generates a substantially constant pump pressure when the input signal to the valve from the control unit drops out, and wherein the constant pump pressure constitutes a maximum pressure.

2. System according to claim 1, wherein the control unit is adapted to determine a desired pump pressure in proportion to the detected load pressure and to generate the control signal with information for controlling the pump correspondingly.

3. System according to claim 2, wherein the control unit is adapted to continuously determine the desired pump pressure and to generate the corresponding signals.

4. System according to claim 1, wherein the system comprises an additional pressure sensor for detecting a pressure which is indicative of an output pressure from the pump, that the control unit is adapted to receive a signal with information about the pressure detected by the pressure sensor and to generate the control signal based upon this information.

5. System according to claim 1, wherein the electrically controlled pump control valve is spring-loaded and adapted to assume the position providing a constant pump pressure via spring, force.

6. System according to claim 1, wherein the electrically controlled pump control valve is adapted to assume the position so that the control signal to the pump is constituted of the pump's own output pressure when the input signal to the pump control valve from the control unit drops out.

7. System according to claim 1, wherein at least one of the actuators is constituted of a hydraulic cylinder.

8. System according to claim 1, wherein the system comprises a first operator-controlled element, that the control unit is adapted to receive a signal with information about the position of the first operator-controlled element and to actuate the electrically controlled valve correspondingly.

9. System according to claim 1, wherein the system comprises at least a first control valve arranged on a conduit between the pump and the first actuator assembly for controlling the movement of the first function.

10. System according to claim 1, wherein the first assembly of actuators is adapted to control a lifting movement of a work implement.

11. System according to claim 1, wherein the system comprises a plurality of assemblies of actuators, which are adapted to control different functions, and at least one pressure sensor associated with each of the actuator assemblies for detecting a load pressure of the respective assembly.

12. System according to claim 1, wherein the system comprises a position sensor for the actuator.

13. Working machine, wherein it comprises a system according to claim 1.

14. Load sensing system, comprising a first assembly of actuators for controlling a first hydraulic function, a pump adapted to supply the actuators with pressurized hydraulic fluid, an electrically controlled valve adapted to control the output pressure of the pump via a hydraulic signal, a first pressure sensor for detecting a load pressure of the first actuator assembly, and a control unit adapted to receive a signal with information about the load pressure detected by the first pressure sensor and to generate a control signal, corresponding to the detected load pressure, to the electrically controlled valve, wherein the control unit is adapted to determine the desired pump pressure so that a differential pressure between the detected load pressure and the pump pressure is varied based upon different operating conditions, wherein a second actuator assembly is adapted to generate a hydraulic signal corresponding to a load pressure thereof, and the system comprises a hydraulic means arranged on a conduit between the electrically controlled pump control valve and the pump and adapted to receive the hydraulic signals from the second actuator assembly and the pump control valve and adapted to control the pump corresponding, to the received signal having the largest load pressure.

15. System according to claim 14, wherein the electrically controlled pump control valve is adapted to assume such a position that the hydraulic signal to the pump generates a substantially constant pump pressure when the input signal to the valve from the control unit drops out.

* * * * *